United States Patent [19]

Yamada

[11] 4,225,015

[45] Sep. 30, 1980

[54] TERMINAL SLOWDOWN APPARATUS FOR ELEVATOR

[75] Inventor: Kunio Yamada, Inazawa, Japan

[73] Assignee: Mitsubishi Denki Kabushiki Kaisha, Tokyo, Japan

[21] Appl. No.: 910,428

[22] Filed: May 30, 1978

[30] Foreign Application Priority Data

May 30, 1977 [JP] Japan ..... 52-63003

[51] Int. Cl.[3] ..... B66B 1/30

[52] U.S. Cl. ..... 187/29 R

[58] Field of Search ..... 187/29

[56] References Cited

U.S. PATENT DOCUMENTS

| | | | |
|---|---|---|---|
| 3,779,346 | 12/1973 | Winkler | 187/29 |
| 4,102,436 | 7/1978 | Kernick et al. | 187/29 |
| 4,124,101 | 11/1978 | Satoh | 187/29 |

*Primary Examiner*—Gene Z. Rubinson
*Assistant Examiner*—W. E. Duncanson, Jr.
*Attorney, Agent, or Firm*—Oblon, Fisher, Spivak, McClelland & Maier

[57] ABSTRACT

A terminal slowdown apparatus for an elevator comprises an acceleration detecting circuit which detects an acceleration in the normal speed pattern or an acceleration of the cage; a relative speed pattern generator which generates a relative speed pattern depending upon the output of the acceleration detecting circuit and the position of the cage and a comparator which is actuated when the normal speed pattern or the cage speed is higher than the relative speed pattern whereby the normal speed pattern is switched to the terminal slowdown speed pattern by the operation of the comparator.

6 Claims, 4 Drawing Figures

TERMINAL SLOWDOWN APPARATUS FOR ELEVATOR

BACKGROUND OF THE INVENTION

The present invention relates to an improved terminal slowdown apparatus for an elevator.

In an elevator, the speed of a cage near the terminal floors is monitored and if an excessive speed is detected, it is necessary to safely land the cage.

As is well known, speed control of the cage is performed depending upon the speed pattern. The elevator has the structure for forming a terminal slowdown speed pattern which is different from the normal speed pattern, when the cage is near the terminal floors.

The terminal slowdown speed pattern is formed by contacting the cage with a landing floor selected in a machine room or a plurality of switches disposed near the terminal floors in a hoistway.

The relations are shown in FIGS. 1 and 2.

In FIG. 1, the reference $\overrightarrow{ABC}$ shows the normal speed pattern of the cage (not shown) in landing at the terminal floor (C) after being driven at a constant speed. The speed of the cage is normally controlled depending upon the normal speed pattern.

The reference $\overrightarrow{DEC}$ designates the lower floor landing speed pattern. If an error occurs in the normal speed pattern $\overrightarrow{ABC}$ to cause the pattern $\overrightarrow{ABE}$, the speed pattern is switched to the terminal slowdown speed pattern to give $\overrightarrow{ABEC}$.

The cage is controlled along the speed pattern $\overrightarrow{ABEC}$ whereby the speed of the cage is changed as shown by the broken line and the cage is safely stopped at the terminal floor (C).

However, when a deceleration is caused before reaching the specific speed, (hereinafter referring to as a short landing operation), the normal speed pattern is given by the reference $\overrightarrow{ABC}$ in FIG. 2.

If the error in the normal speed pattern occurs during an acceleration of the cage, the speed pattern is varied to the speed pattern $\overrightarrow{A'B'E'C}$ and the speed of the cage is changed so as to be shown by the broken line.

As it is clear from the drawings, the acceleration of the cage is significantly large in the negative direction and the sudden deceleration causes a shock to the passengers in the cage to provide an insecure feeling.

SUMMARY OF THE INVENTION

It is an object of the present invention to overcome the abovementioned disadvantages and to provide a terminal slowdown apparatus which safely lands a cage without any insecure feeling even though the normal speed pattern is switched to the terminal slowdown speed pattern during an acceleration of the cage.

The foregoing and other objects of the present invention have been attained by providing a terminal slowdown apparatus for an elevator by switching the normal speed pattern to a terminal slowdown speed pattern whenever the normal speed pattern causes over the terminal slowdown speed pattern near the terminal floors which comprises an acceleration detecting circuit which detects an acceleration in the normal speed pattern or an acceleration of the cage; a relative speed pattern generator which forms a relative speed pattern depending upon the output of the acceleration detecting circuit and the position of the cage; and a comparator which is actuated when the normal speed pattern or the cage speed is higher than the relative speed pattern; whereby the normal speed pattern is switched to the terminal slowdown speed pattern by the operation of the comparator.

BRIEF DESCRIPTION OF THE DRAWINGS

FIGS. 1 and 2 show respectively speed pattern curves in the conventional terminal slowdown apparatus of an elevator wherein FIG. 1 shows a long landing operation and FIG. 2 shows a short landing operation;

DETAILED DESCRIPTION OF THE PREFERRED EMBODIMENTS

Figure 1:
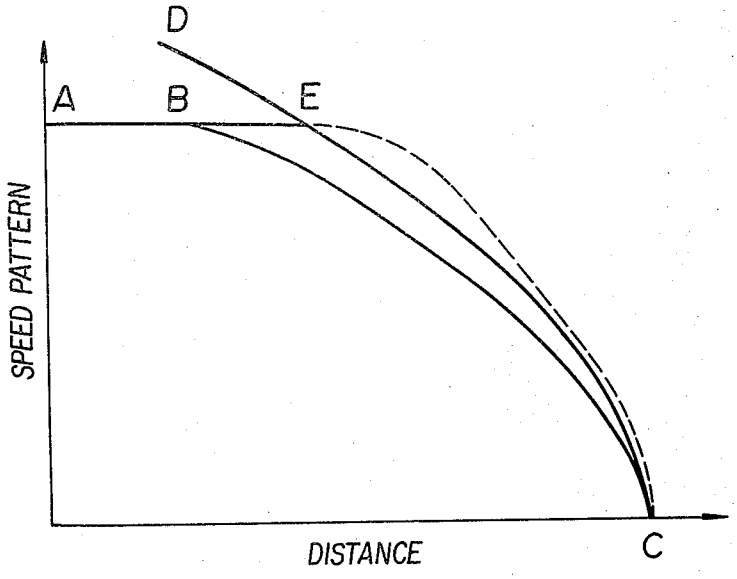
Figure 2:
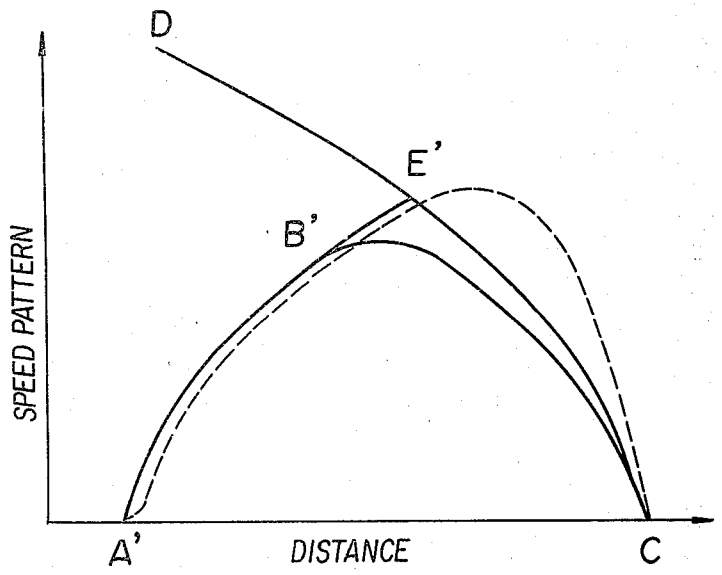
Figure 3:
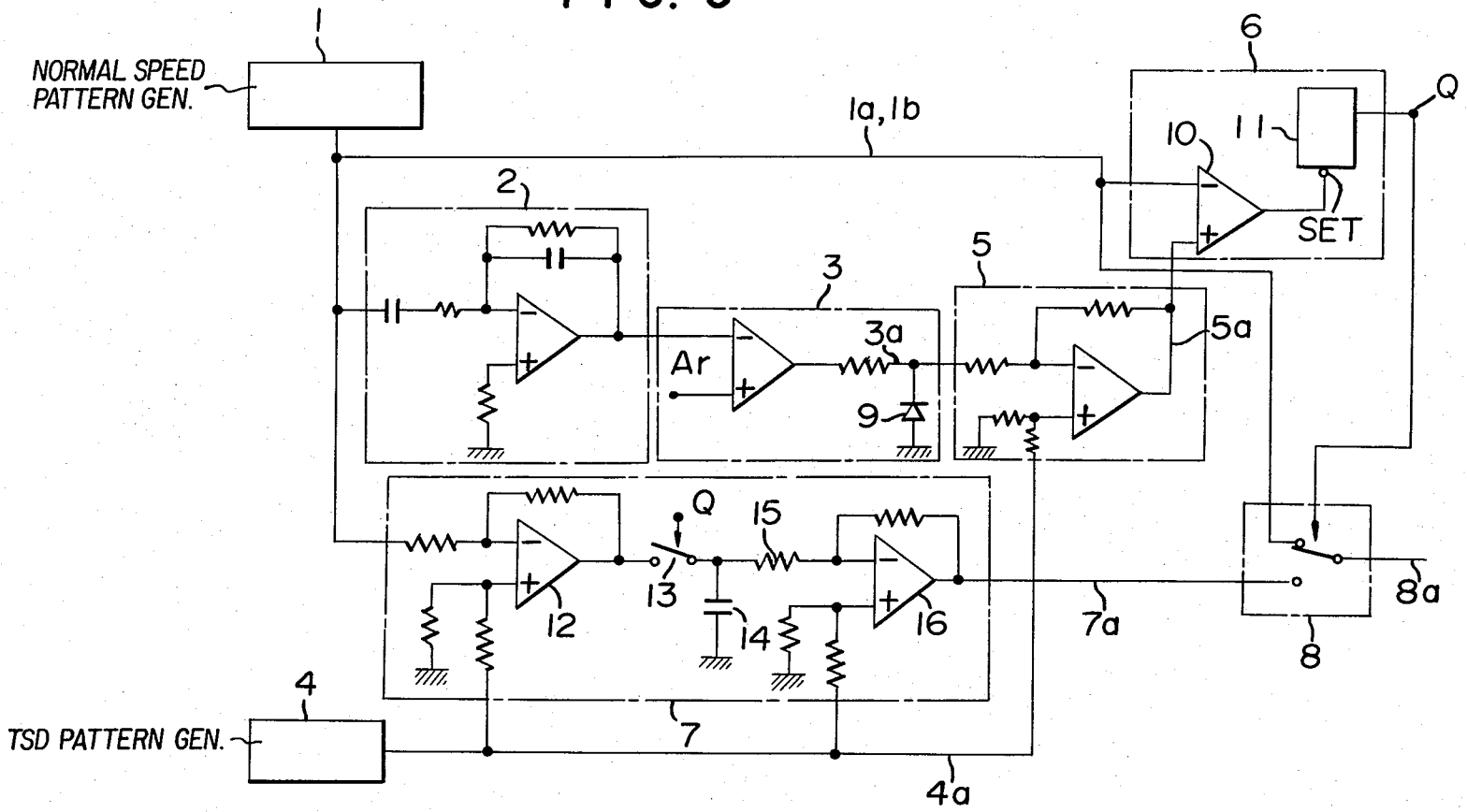
FIG. 3 is a block diagram of one embodiment of the terminal slowdown apparatus for an elevator according to the present invention.
Figure 4:
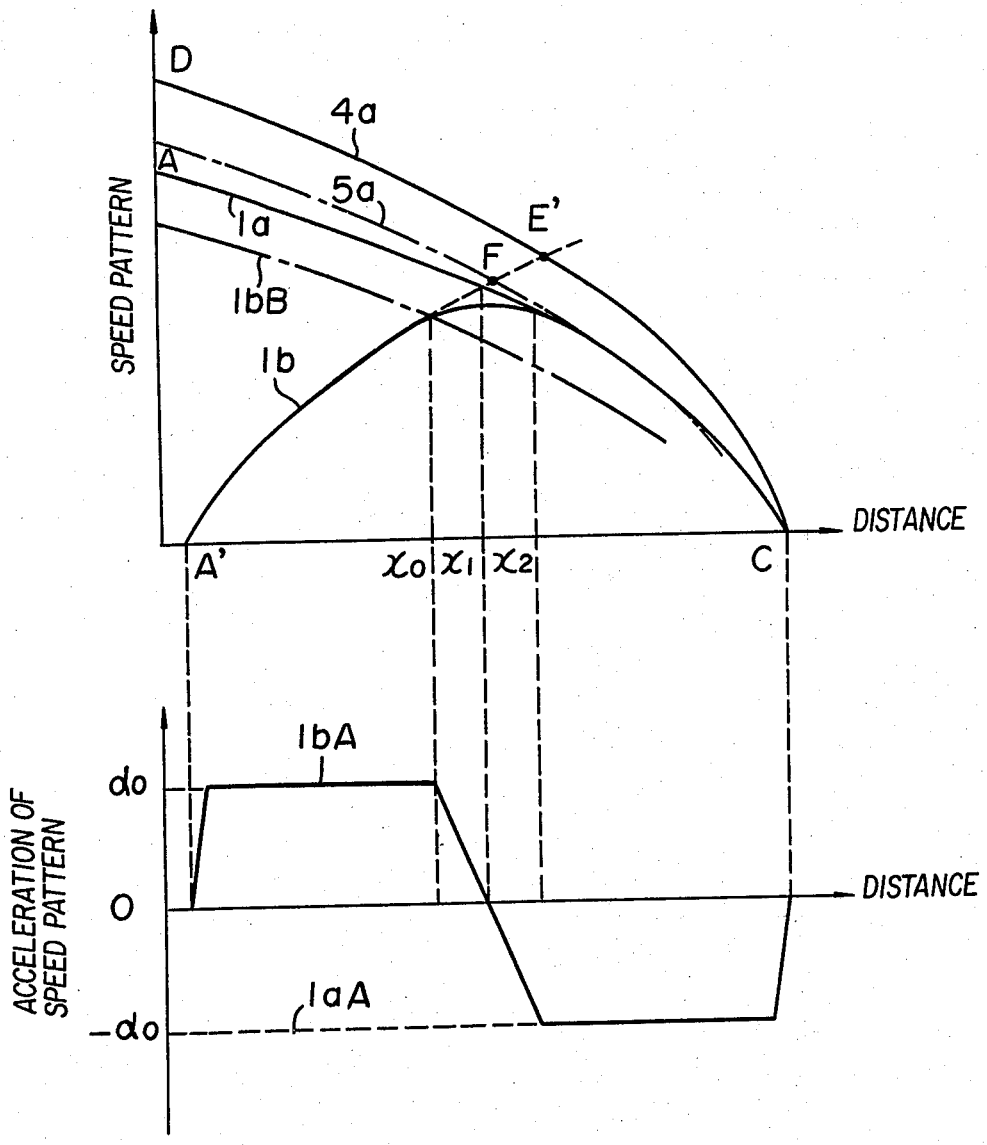
FIG. 4 shows characteristic curves of the speed pattern and the acceleration in the embodiment of FIG. 3.

Referring to FIGS. 3 and 4, one embodiment of the present invention will be illustrated.

In FIG. 3, the reference (1) designates a normal speed pattern generator which generates normal speed patterns **(1*a*), (1*b*); (2) designates a differentiator; (3) designates an acceleration function generator for generating a constant output (3*a*) during an acceleration of the cage; (4) designates a terminal slowdown speed pattern generator which generates the terminal slowdown speed pattern (4*a*); (5) designates an subtractor; (5*a*) designates an output of the subtractor as the relative speed pattern; (6) designates a comparator; (7) designates a fall distance adjuster; (8) designates a switch and (8*a*)** designates an output as a speed pattern.

The normal speed pattern **(1*a*) is given in the long landing operation and the normal speed pattern (1*b*)** is given in the short landing operation.

The reference (9) designates a diode; (10) designates a comparator; (11) designates a flip-flop; (12) designates a subtractor; (13) designates a switch; (14) designates a capacitor; (15) designates a resistor; (16) designates a subtractor.

In the normal speed pattern generator, the normal speed pattern can be the same with the output SRAT of the speed pattern generator (48) under the OFF state of the analog switch (560) in U.S. Pat. No. 3,750,850.

In the terminal slowdown speed pattern generator, the terminal slowdown speed pattern can be the same with the output TSAN of the terminal slowdown (558) in the speed pattern generator (48) in U.S. Pat. No. 3,750,850.

The differentiator (2) outputs a value being proportional to an acceleration of the speed pattern **(1*a*)**.

The acceleration function generator (3) outputs a positive specific value when the output of the differentiator is negative but the absolute value of the output is larger than the reference value $A_r$ whereas it outputs about zero volts because of the diode (9) when the output is positive or smaller in negative value than the reference value $A_r$.

The relative speed pattern **(5*a*) is output from the subtractor (5) of the circuit for subtracting the output (3*a*) of the acceleration function generator from the terminal slowdown speed pattern (4*a*)**.

The comparator (10) compares the normal speed pattern **(1*a*) with the relative speed pattern (5*a*). When the normal speed pattern (1*a*) is larger than the relative speed pattern (5*a*), the low signal is input to the SET terminal of the flip-flop (11)** to form high signal for the output Q of the flip-flop.

The fall distance adjuster (7) includes a subtractor (12) which outputs the difference between the normal speed pattern and the terminal slowdown pattern. The switch (13) is in the ON state when the output Q of the comparator is low whereby the potential of the capacitor (14) is the same with the output of the subtractor (12).

The switch (13) is in the OFF state when the output Q of the comparator is high, and the capacitor is discharged through the resistor (15). The subtractor (16) subtracts the voltage of the capacitor from the terminal slowdown pattern to form the modified terminal slowdown pattern (7*a*).

The switch (8) selects the normal speed pattern when the output Q of the comparator (6) is low and selects the modified terminal slowdown pattern when the output Q of the comparator (6) is high.

In FIG. 4, the reference (1*a*A) designates the acceleration in the normal speed pattern (1*a*); (1*b*A) designates the acceleration in the normal speed pattern (1*b*); and (1*b*B) designates a command for reducing the acceleration in the short landing operation.

That is, in the normal speed pattern (1*b*) for the short landing operation, the decrease of the acceleration is commanded at the point $X_0$ to give zero acceleration at the point $X_1$, and at the point $X_2$, the normal speed pattern (1*b*) corresponds to the normal speed pattern (1*a*) for the long landing operation.

When the value of the normal speed pattern (1*a*) is given as $V_{1a}$ and the value of the terminal slowdown speed pattern (4*a*) is given as $V_{4a}$, the value $V_{5a}$ of the relative speed pattern (5*a*) in the case of the normal speed pattern (1*a*) of $V_{1b}$ is preferably selected by the equation:

$$V_{5a}=V_{4a}-[V_{1a}-V_{1b}] \quad (1)$$

The second term of the right side of the equation (1) $V_{1a}-V_{1b}$ can be shown as the function $F(\alpha)$ for the acceleration $\alpha$ of the speed pattern.

That is, the equation can be modified as the equation:

$$V_{5a}=V_{4a}-F(\alpha) \quad (2)$$

In the following embodiment, the output (3*a*) of the acceleration function device (3) which forms a constant value during the acceleration is used instead of the function $F(\alpha)$ in the equation (2) so as to simply describe the embodiment.

Thus, when the cage approaches to the terminal floor (C) in a deceleration in the long landing operation, the output (3*a*) of the acceleration function device is zero even though the differentiator (2) generates the output. Accordingly, the speed pattern (5*a*) is the same with the speed pattern (4*a*).

The speed pattern (1*a*) and the speed pattern (4*a*) are compared by the comparator (6). The cage is controlled along the pattern (1*a*) in the case of pattern (1*a*)<pattern (4*a*) whereas the speed pattern of the apparatus is switched to the speed pattern (4*a*) in the case of pattern (1*a*)>pattern (4*a*), as described above.

When the cage is started from the point A′ to perform the short landing operation, the acceleration function device (3) generates a specific output (3*a*) in the acceleration. Accordingly, the relative speed pattern (5*a*) as the output of the subtractor (5) is the pattern given by subtracting the output (3*a*) from the pattern (4*a*) and this is $V_{5a}$ shown by the equation (2).

The speed pattern (1*b*) and the relative speed pattern (5*a*) are compared by the comparator (6), and the cage is controlled along the speed pattern (1*b*) during the condition of pattern (1*b*)<pattern (5*a*). When it is changed to the condition of pattern (1*b*)>pattern (5*a*) at point, F the comparator (6) generates the output and the switch (8) is actuated and the speed pattern (4*a*) is switched to the speed pattern (8*a*) through the fall distance adjuster (7) and the cage is controlled along the speed pattern (8*a*).

The fall distance adjuster (7) has the function for smoothing the speed pattern by adjusting the speed pattern fall when the normal speed pattern (1*b*) is switched to the terminal slowdown speed pattern (4*a*).

As it is clearly understood by the drawings, point F is nearer than point E′, whereby the cage is landed at the terminal floor (C) without rapid deceleration to cause an insecure feeling.

In said embodiment, the normal speed patterns (1*a*), (1*b*) are used for detecting the acceleration. It is also possible to use a differential value of the output of a tachometer dynamo (not shown) for indicating the speed of the cage or to use an acceleration reducing command (1*b*B).

It is also possible to substitute the normal speed patterns (1*a*), (1*b*) as one of the inputs of the comparator (6) with the speed signal for indicating the speed of the cage.

In said embodiment, the acceleration function device (3) is used for $F(\alpha)$ in the equation (2).

Thus, it is clear to give superior driving for the terminal slowdown by using a function device for providing the function being closer to $F(\alpha)$ instead of the acceleration function device (3).

As described above, in accordance with the present invention, the acceleration of the normal speed pattern or the acceleration of the cage is detected and the relative speed pattern is provided depending upon the detected acceleration and the position of the cage and the normal speed pattern is switched to the terminal slowdown speed pattern when the normal speed pattern or the speed of the cage becomes higher than the relative speed pattern, whereby the cage can be safely landed at the terminal without insecure feeling even though the terminal slowdown operation is started during the acceleration in the short landing operation.

What is claimed is:

1. In a terminal slowdown apparatus for an elevator which functions by switching the normal speed to a terminal slowdown speed pattern whenever the normal speed pattern increases over the terminal slowdown speed pattern near the lower floor, an improvement which comprises an acceleration detecting circuit which detects any acceleration in the normal speed pattern or an acceleration of the cage;

a relative speed pattern generator which forms a relative speed pattern depending upon the output of the acceleration detecting circuit and the position of the cage and a comparator which is actuated when the normal speed pattern or the cage speed becomes higher than the relative speed pattern; whereby the normal speed pattern is switched to the terminal slowdown speed pattern by the operation of the comparator.

2. A terminal slowdown apparatus according to claim 1 wherein an acceleration function device is used.

3. A terminal slowdown apparatus according to claim 1 wherein a tachometer dynamo is used for indicating the speed of the cage and the acceleration is detected by a differential value of the output of the tachometer dynamo.

4. A terminal slowdown apparatus according to claim 1 wherein an acceleration reducing command is used for detection of the acceleration.

5. A terminal slowdown apparatus for an elevator car comprising:

a normal speed pattern generator for generating at an output normal speed pattern signals for said elevator car;

a terminal slowdown speed pattern generator for generating at an output terminal slowdown speed pattern signals;

means for detecting acceleration of said elevator car past a specified maximum value from said normal speed pattern signals;

means for producing relative speed pattern signals;

said relative speed pattern signals being produced by a subtractor means which subtracts an output from said means for detecting acceleration from said terminal slowdown speed pattern signals;

comparator means for comparing said normal speed pattern signals with said relative speed pattern signals;

said comparator means producing an output signal whenever the magnitude of said normal speed pattern signals exceeds the magnitude of said relative speed pattern signals;

switch means interposed between said output from said comparator means, said output from said terminal slowdown speed pattern generator, said output from said normal speed pattern generator and said elevator car;

said switch means allowing said normal speed pattern signals to operate said elevator car when no output signal appears on said output from said comparator means and allowing said terminal slowdown speed pattern signals to operate said elevator car when an output signal appears on said output from said comparator means whereby said elevator car can be decelerated to a safe landing.

6. A terminal slowdown apparatus according to claim 5 wherein said means for detecting acceleration of said elevator car includes a differentiator in series with an acceleration function generator which generates a constant output during acceleration of said elevator car.

* * * * *